US007765924B2

(12) United States Patent
Suda

(10) Patent No.: US 7,765,924 B2
(45) Date of Patent: Aug. 3, 2010

(54) STAMP

(75) Inventor: Mitsunobu Suda, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 551 days.

(21) Appl. No.: 10/556,072

(22) PCT Filed: Sep. 21, 2004

(86) PCT No.: PCT/JP2004/013725

§ 371 (c)(1),
(2), (4) Date: Nov. 30, 2006

(87) PCT Pub. No.: WO2005/042260

PCT Pub. Date: May 12, 2005

(65) Prior Publication Data

US 2007/0169644 A1 Jul. 26, 2007

(30) Foreign Application Priority Data

Oct. 31, 2003 (JP) ..... 2003-373713

(51) Int. Cl.

| | |
|---|---|
| ***B41J 1/60*** | (2006.01) |
| ***B41F 31/00*** | (2006.01) |
| ***B41K 1/38*** | (2006.01) |
| ***B41K 1/10*** | (2006.01) |
| ***B41K 1/08*** | (2006.01) |

(52) U.S. Cl. ..... 101/111; 101/327

(58) Field of Classification Search ..... 101/111, 101/109, 105, 104, 103, 327, 333, 334
See application file for complete search history.

(56) References Cited

U.S. PATENT DOCUMENTS

| | | | | |
|---|---|---|---|---|
| 3,796,152 | A | 3/1974 | Finke et al. | |
| 4,290,358 | A | 9/1981 | Hamisch, Jr. | |
| 4,858,526 | A * | 8/1989 | Bengtsson | 101/111 |
| 5,799,576 | A * | 9/1998 | Koike et al. | 101/111 |
| 5,939,734 | A * | 8/1999 | Hamaguchi | 257/94 |

(Continued)

FOREIGN PATENT DOCUMENTS

| | | |
|---|---|---|
| EP | 0 786 354 A2 | 7/1997 |

(Continued)

*Primary Examiner*—Judy Nguyen
*Assistant Examiner*—Leo T Hinze
(74) *Attorney, Agent, or Firm*—Oliff & Berridge, PLC

(57) ABSTRACT

This invention provides a stamp which enables a print image combining a fixed print face with a changeable print face to be visibly recognized through a sample. A date stamp forms a print image by synthesizing a fixed print face with a movable print face arbitrarily selectable by operating an operation portion. The movable print faces are provided on the outer face of a belt body in a plurality of quantity. Samples of the print images of the movable print faces are printed on the outside face on an opposite side of the belt body. Each movable print face and sample are matched with each other so that the sample of the print image of the movable print face located at a side face of a holding body is located on other side face. A user can see a sample of the print image of the fixed print face and a sample seen through a sample window as an image of a stamp result through a sample face on an opposite side to the print face.

15 Claims, 11 Drawing Sheets

U.S. PATENT DOCUMENTS

| | | | | |
|---|---|---|---|---|
| 6,009,805 | A | 1/2000 | Miketa et al. | |
| 6,834,584 | B1 * | 12/2004 | MacNeil | 101/333 |
| 6,935,231 | B2 | 8/2005 | Naritomi | |

FOREIGN PATENT DOCUMENTS

| | | | |
|---|---|---|---|
| EP | 0 867 303 | A1 | 9/1998 |
| GB | 2 064 435 | A | 6/1981 |
| JP | A 56-106890 | | 8/1981 |
| JP | A-61-083090 | | 4/1986 |
| JP | Y2-02-005973 | | 2/1990 |
| JP | U-06-050864 | | 7/1994 |
| JP | A-07-186502 | | 7/1995 |
| JP | A-08-115634 | | 5/1996 |
| JP | A-08-230291 | | 9/1996 |
| JP | A-09-109529 | | 4/1997 |
| JP | A-09-263028 | | 10/1997 |
| JP | U-3066691 | | 12/1999 |
| JP | A-2001-205910 | | 7/2001 |
| WO | WO 03/037640 | A1 | 5/2003 |

* cited by examiner

STAMP

TECHNICAL FIELD

The present invention relates to a stamp capable of forming a print image by combining a fixed print face with a changeable print face.

BACKGROUND ART

As a stamp for forming a print image of data and the like including date to be pressed on a document or the like, conventionally, a date stamp and other ones have been used. Such a date stamp can form a single print image by combining a fixed print face which is fixed to produce a print image of, for example, a company name, division name and the like and a non-fixed print face which is changeable to form a print image of a date and the like.

Generally, in the date stamp, there are provided a plurality of non-fixed print faces on the top of a rotatable belt and when changing the date of the date stamp, a user selects an optimum non-fixed print face by rotating its belt while looking at the non-fixed print face. At this time, a user needs to select an optimum one by looking at the non-fixed print face inverted in terms of the right and left sides. Further, after use, ink or the like adheres to the non-fixed print face and thus, its print image is difficult to see.

Thus, according to the patent document 1, a window (opening portion) loaded with a magnification lens is provided on a side face of the date stamp (data stamp) and its belt (endless print plate belt) can be seen through a magnification lens. A print image of the non-fixed print face is printed between two non-fixed print faces (print plates) on the belt and thus, the print image of a selected non-fixed print face (to be pressed) can be seen through the window.

Patent document 1: Japanese Patent Application Laid-Open No. HEI7-186502

DISCLOSURE OF THE INVENTION

However, according to the patent document 1, to see what stamp image is formed by a combination of the fixed print face and the non-fixed print face when that date stamp is pressed, it is necessary to actually see the print face or execute trial stamping.

The present invention has been made to solve the above-described problem and an object of the invention is to provide a stamp which enables a print image combining a fixed print face with a changeable print face to be visibly recognized through a sample.

Means for Solving the Problem

To achieve the above-described object, the stamp of the present invention comprises: a movable print body including a plurality of print faces provided protrudedly along an outer face of a belt supported movably; an exposure hole for exposing one of the plurality of print faces of the movable print body out of a main body case; a plurality of print image samples corresponding to the plurality of print faces of the movable print body; and a sample window provided in a face different from that of the main body case provided with the exposure hole to enable the print image sample corresponding to a print face exposed through the exposure hole to be seen from outside the main body case, these components being included in the main body case.

The stamp of the present invention may further comprise: a fixed print body which constitutes the face of the main body case provided with the exposure hole and has a print face for forming a print image synthesized together with the print face of the movable print body exposed through the exposure hole; and a sample of the print image of a print face of the fixed print body, synthesized with a sample of the print image of a print face of the movable print body visible through the sample window, such that it is visibly recognizable.

The main body case may be constructed cylindrically while the exposure hole and the sample window are provided on the side face at an end and the side face at the other end of the main body case.

Further, the stamp of the present invention may further comprise a transparent cover for covering the side face at the other end of the main body case to protect the sample window, wherein a sample of print image of a print face of the fixed print body is held between the main body case and the cover.

The sample of the print image of the print face of the fixed print body may have a positioning piece for positioning at ends thereof and the side face of the other end of the main body case has an engaging portion which the positioning piece engages.

The sample of the print image of the print face of the fixed print body may have a monitoring hole enabling the sample of the print image of the print face of the movable print body to be seen, wherein the cover has a fitting piece capable of being fit to the monitoring hole.

Further, the sample of the print image of the print face of the movable print body may be printed on an outside face of the belt of the movable print body, provided with no protruded print faces.

The sample of the print image of the print face of the movable print body may be printed on a belt-like film member to be bonded to the outside face of the belt of the movable print body, provided with no protruded print faces.

Further, the sample of the print image of the print face of the movable print body may be printed on the belt-like film member, a positioning hole for positioning to the movable print body is made in the film member and a positioning protrusion which is fit to the positioning hole in the film member is provided protrudedly on the outside face of the movable print body provided with no protruded print faces.

The fixed print body may be provided so as to be attachable to or detachable from the main body case, and the movable print body is supported by the main body case such that its positional relation with the sample window is not changed.

The stamp of the present invention may further comprise: a moving means capable of moving the movable print body to select an arbitrary print face from the plurality of print faces of the movable print body; and a load applying means for, when the respective print faces are pulled out of the exposure hole in order to move the movable print body with the moving means, applying load to the moving means to make it difficult for the movable print body to move.

EFFECT OF THE INVENTION

Because the stamp of the present invention enables which print face of a plurality of ones on the movable print body is exposed through the exposure hole to be recognized by looking at a sample of the print image, it is possible to set up to obtain an object print image without trial stamping.

Further, because the stamp of the present invention enables a result of stamping to be recognized by looking at a sample of a print image which synthesizes a print image of the print face of the movable print body with a print image of the print face of the fixed print body, it is possible to set up to obtain an object print image even if no trial stamping is made.

Because the stamp of the present invention has a sample window in the side face at the other end which is a top face of the main body case when stamping is made downward, it is not necessary to peep into the print face to recognize a print image. Further, while the print face is a mirror image of a print image, the sample is a real image of the print image so the print image is easy to recognize.

Because the stamp of the present invention is capable of protecting the sample window for recognizing a sample of a print image with a transparent cover, dust and the like can be prevented from invading into the inside of the main body case.

Because the sample of the print image of the fixed print body is not changeable in the stamp of the present invention, when the sample of the print image of the fixed print body is disposed in the main body case for the sample of the print image synthesized with the sample of the changeable print image of the movable print body not to differ from an actual print result, deflection in position is unlikely to occur.

Because the sample of the print image of the fixed print body is not changeable, when the sample of the print image of the fixed print body is disposed on a transparent cover for the sample of the print image synthesized with the sample of the changeable print image of the movable print body not to differ from an actual print result, deflection in position is unlikely to occur.

Because in the stamp of the present invention, when the belt is moved to change an arbitrary print face of the movable print body, the sample of the print image printed on that belt can be changed, the structure for changing the sample of the print image can be simplified.

In the stamp of the present invention, by moving the belt to change the arbitrary print face of the movable print body, the sample of the print image can be changed. By printing the sample of the print image on a film member, which is easier to perform than printing directly on the belt, production process can be simplified.

According to the stamp of the present invention, when the belt is moved to change an arbitrary print face of the movable print body, the sample of the print image can be changed also. Positioning of the sample of the print image to the belt can be carried out easily, so that the production process can be simplified.

Although in the stamp of the present invention, the movable print body cannot move unless the print face of the movable print body is pulled out of the exposure hole, because the positional relation between the movable print body and the sample window is not changeable, this can be done if the fixed print body is departed from the main body case. As a result, the print face of the movable print body can be changed while looking at the sample of the print image.

Because in the stamp of the present invention, load is applied when the print face is pulled out of the exposure hole in order to select a print face of the movable print body, moving of the movable print body is difficult to stop at a position where any print face cannot be exposed, so that the print face can be selected easily.

BEST MODE FOR CARRYING OUT THE INVENTION

Figure 1:
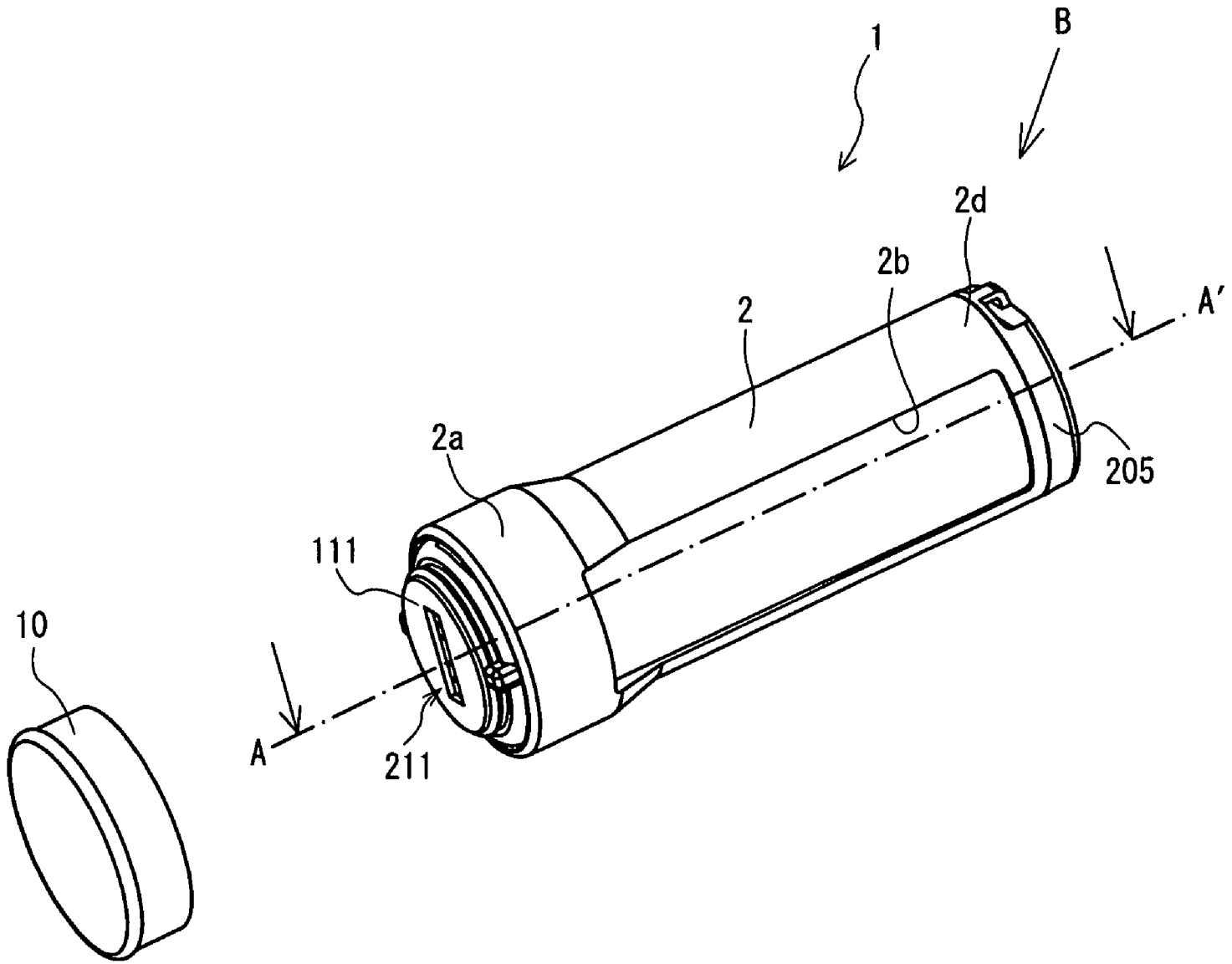
FIG. 1 is a perspective view of a date stamp 1 in a condition enabling itself to be pressed down as seen from the side of the print face.
Figure 2:
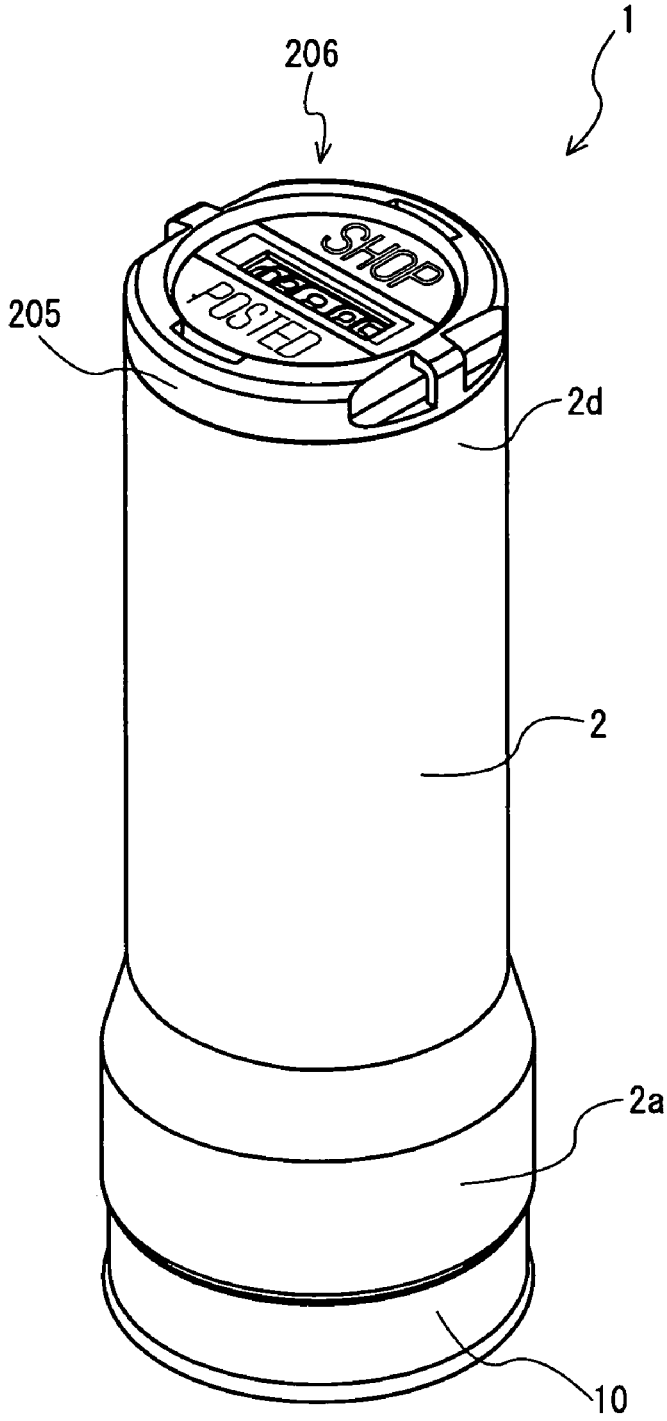
FIG. 2 is a perspective view of the date stamp 1 as seen from its rear end portion 205 as indicated with an arrow B in FIG. 1.
Figure 3:
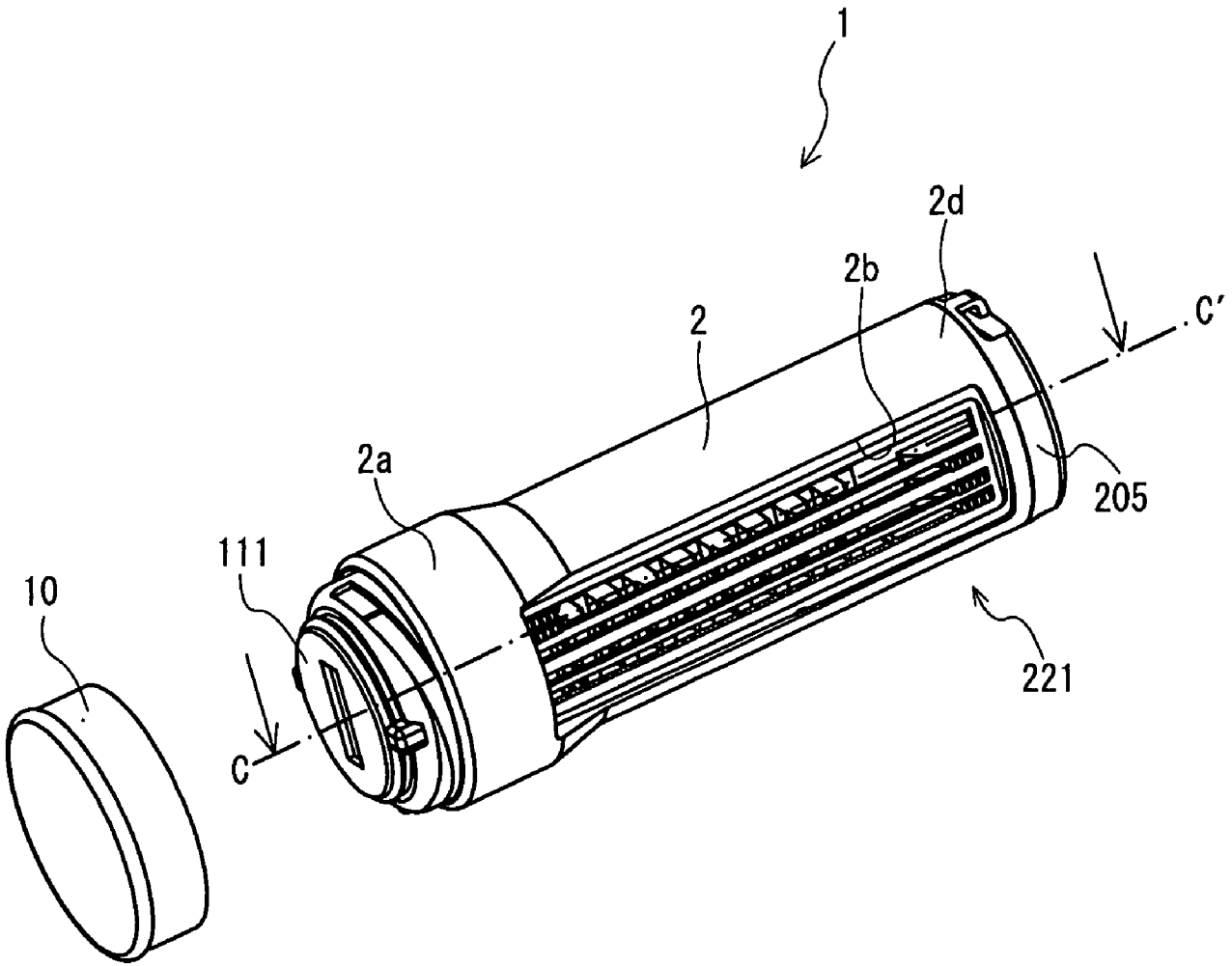
FIG. 3 is a perspective view of the date stamp 1 in a condition enabling its movable print face 211 to be changed, as seen from the side of the print face.
Figure 4:
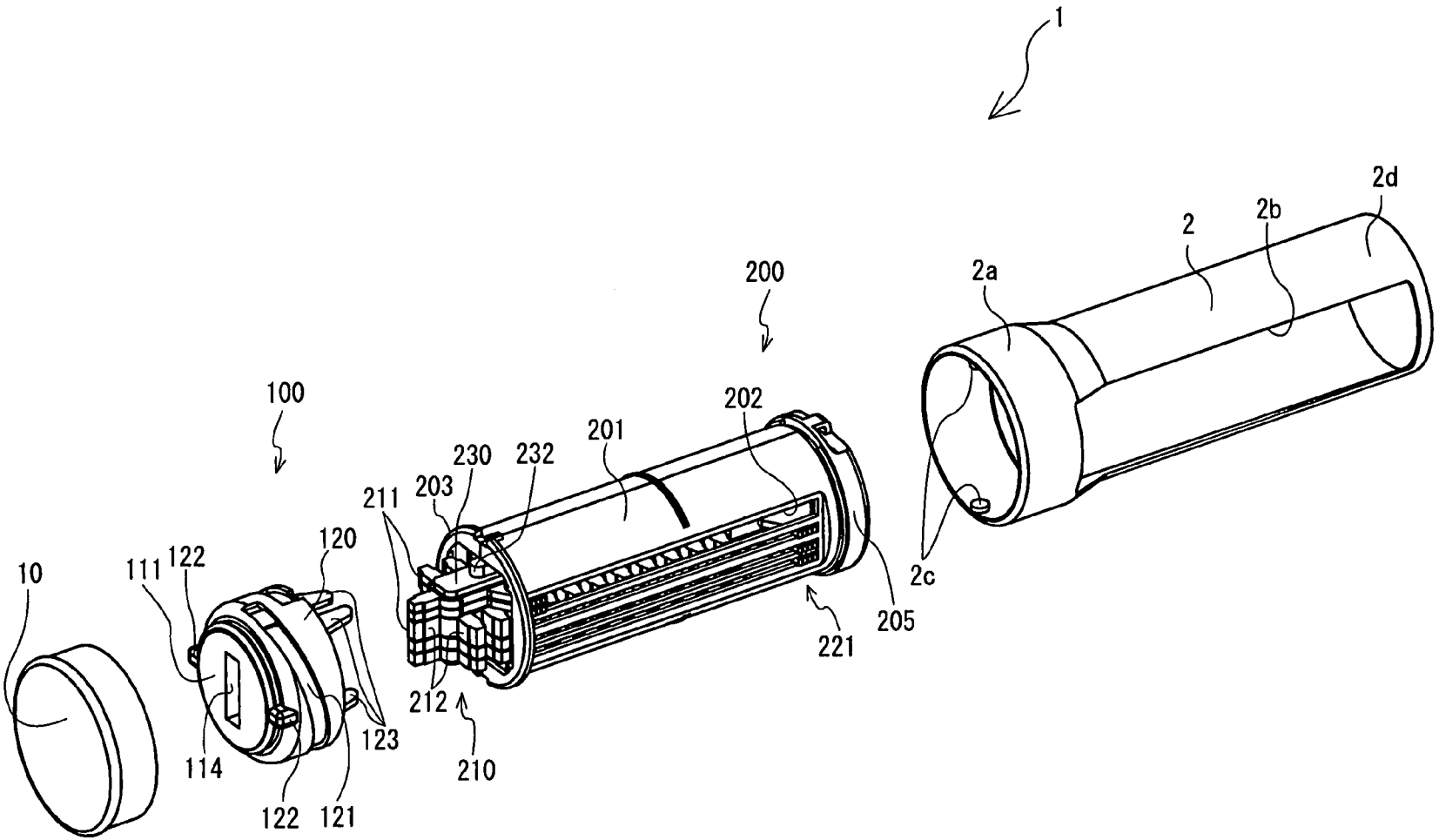
FIG. 4 is a disassembly perspective view of the date stamp 1.
Figure 5:
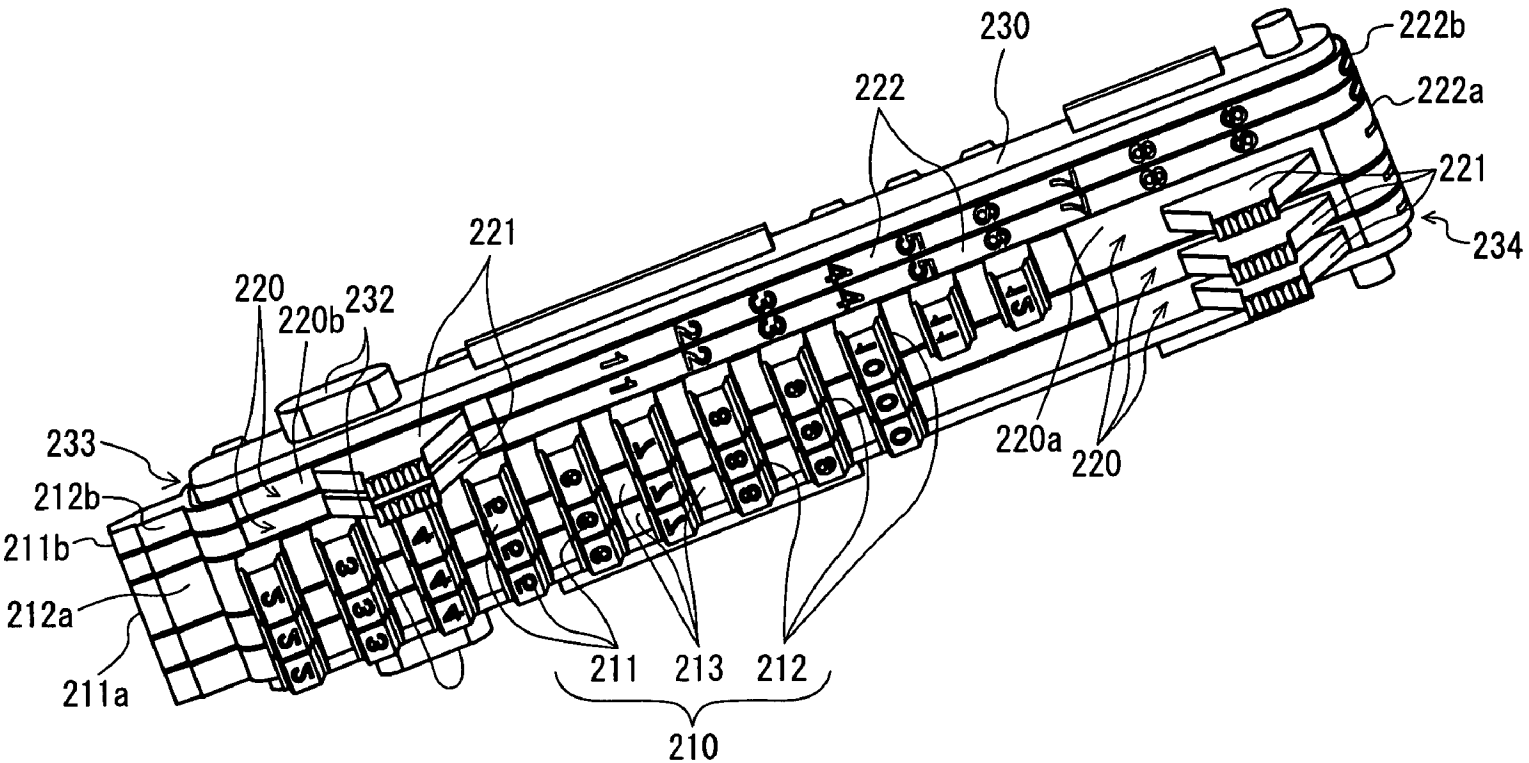
FIG. 5 is a perspective view of a holding body 230 in which a movable print body 210 is held.
Figure 6:
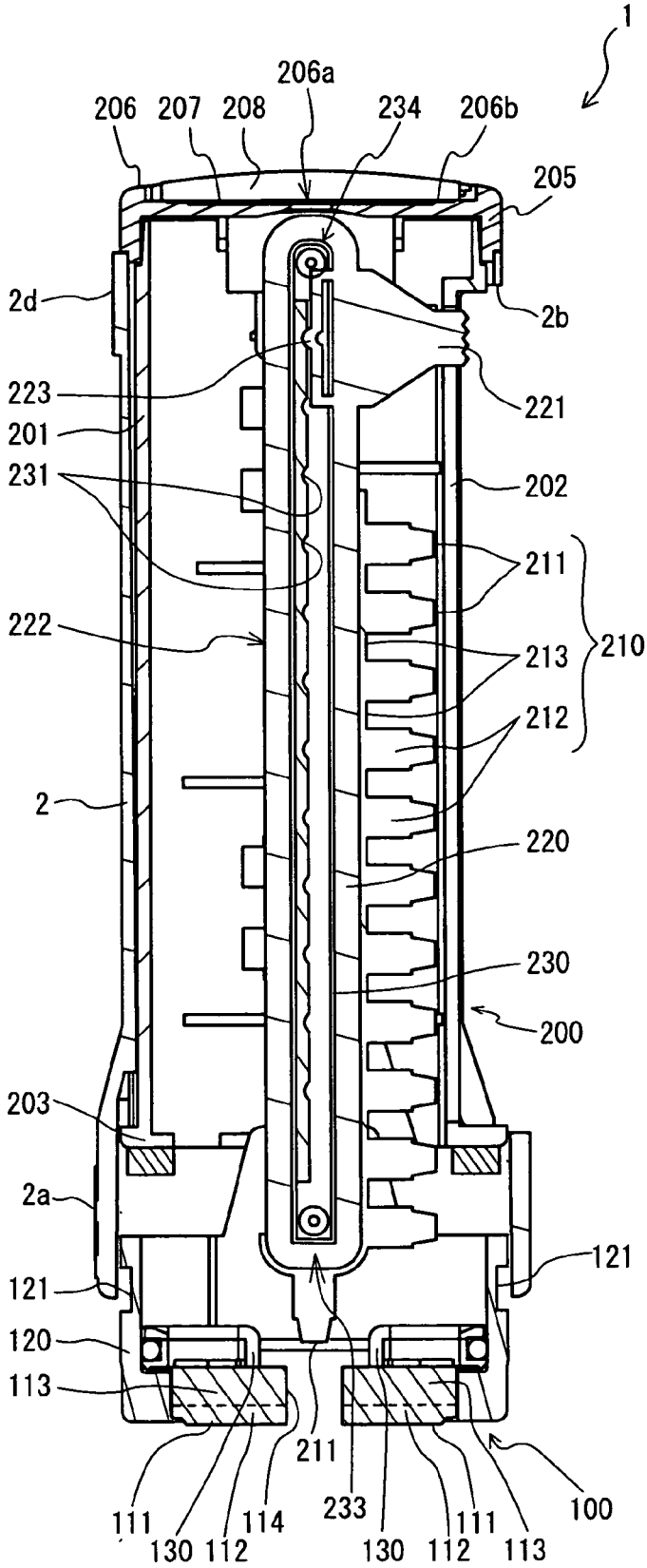
FIG. 6 is a sectional view of the date stamp 1 in a condition enabling the movable print face 211 to be changed as seen along arrows on a dot and dash line C-C' shown in FIG. 3.
Figure 7:
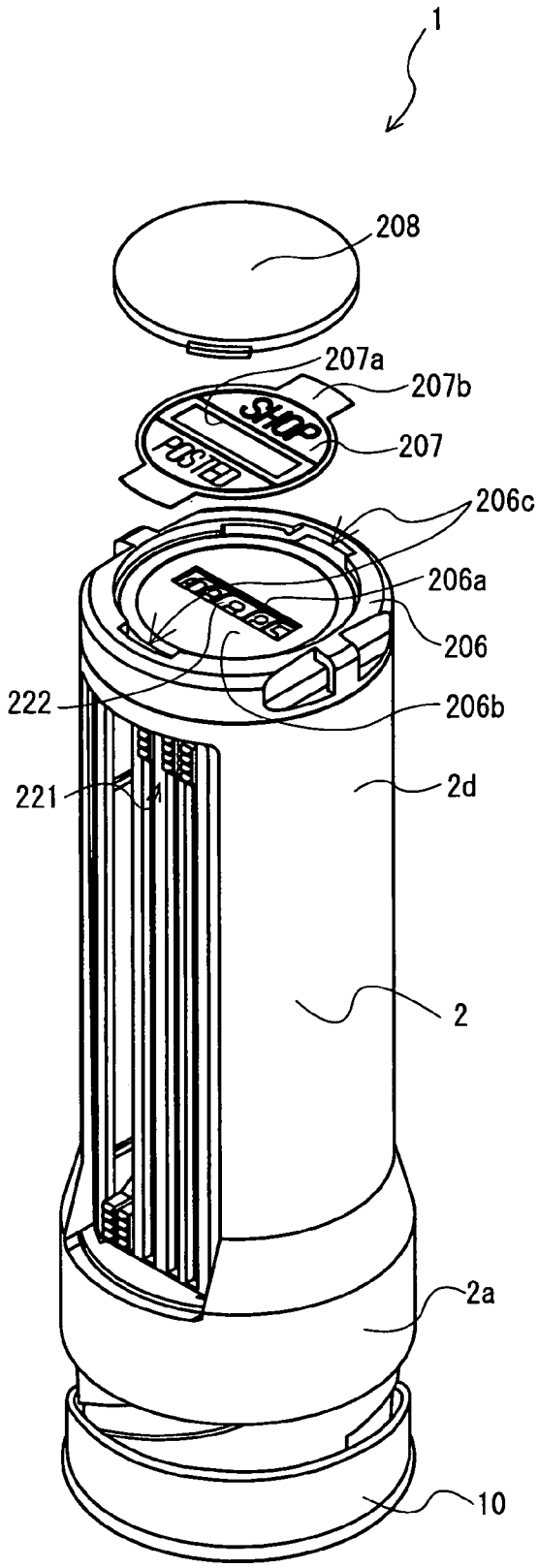
FIG. 7 is a disassembly perspective view of major portions of the date stamp 1 as seen from the rear end portion 205.
Figure 8:
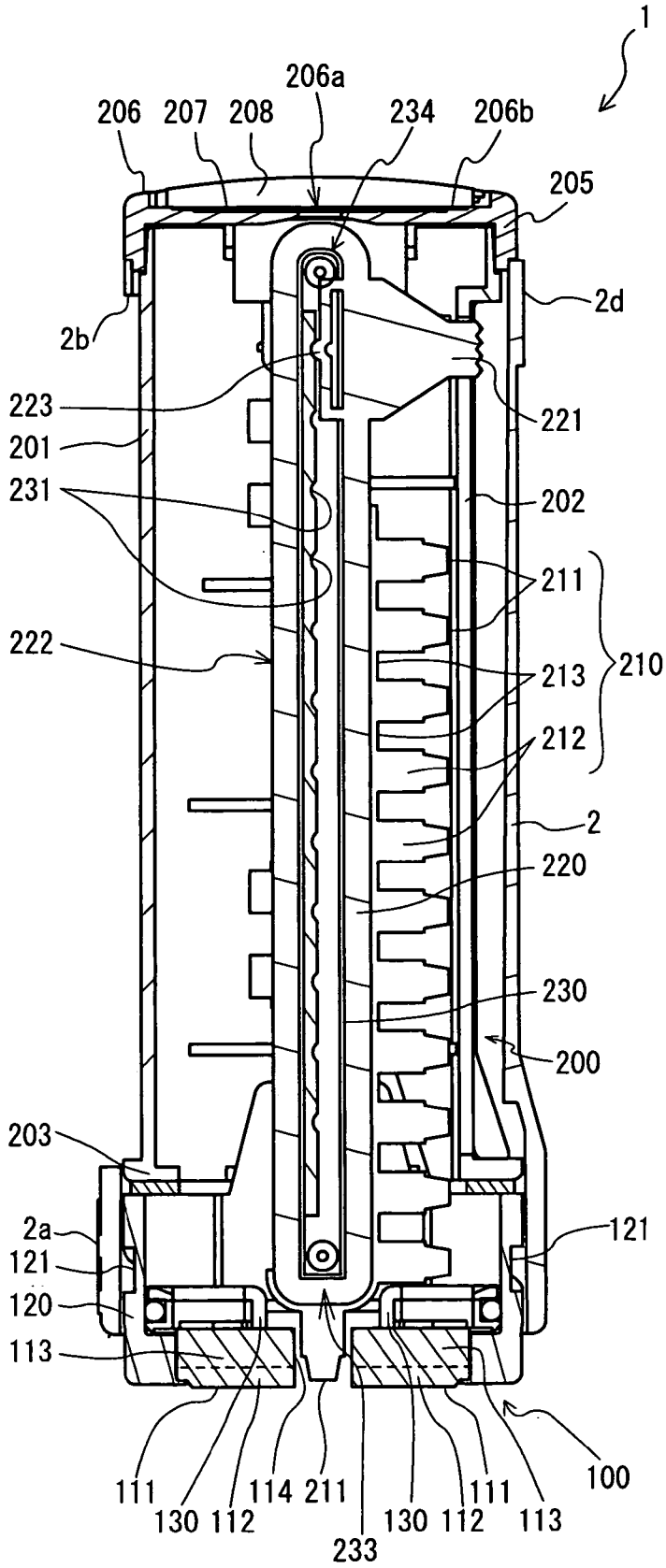
FIG. 8 is a sectional view of the date stamp 1 in a condition enabling the movable print face 211 to be pressed as seen along arrows on a dot and dash line A-A' shown in FIG. 1.

Hereinafter the embodiment of the stamp of the present invention will be described about a date stamp 1 which is an example thereof. FIG. 1 is a perspective view of the date stamp 1 in a condition enabling itself to be pressed as seen from the print face. FIG. 2 is a perspective view of the date stamp 1 as seen from its rear end portion 205 as indicated with an arrow B in FIG. 1. FIG. 3 is a perspective view of the date stamp 1 in a condition enabling its movable print face 211 to be changed, as seen from the side of the print face. FIG. 4 is a disassembly perspective view of the date stamp 1. FIG. 5 is a perspective view of a holding body 230 in which a movable print body 210 is held. FIG. 6 is a sectional view of the date stamp 1 in a condition enabling the movable print face 211 to be changed as seen along arrows on a dot and dash line C-C' shown in FIG. 3. FIG. 7 is a disassembly perspective view of major portions of the date stamp 1 as seen from the rear end portion 205. FIG. 8 is a sectional view of the date stamp 1 in a condition enabling the movable print face 211 to be pressed as seen along arrows on a dot and dash line A-A' shown in FIG. 1.

As shown in FIG. 1, the date stamp 1 has a substantially cylindrical main body case 2 and the bore of a cylinder end portion 2*a* on one side of the main body case 2 is formed slightly larger than the diameter of the body. A print face for forming a print image on a printing object material is provided on the cylinder end portion 2*a*. The print face is a substantially circular print face having a face perpendicular to the axial direction of the main body case 2 and constructed to form a single print image by synthesizing a fixed print face 111 having an unchangeable print image and a movable print face 211 capable of forming an arbitrary print image such as date by combining numerals and symbols. A cap 10 for covering the fixed print face 111 and the movable print face 211 for protection when the date stamp 1 is not used is provided on the main body case 2 so as to be attachable to or be detachable from the cylinder end portion 2*a*.

As shown in FIG. 2, a rear end portion 205 fixed to a supporting case 201 (see FIG. 4) accommodated in the main body case 2 and relatively rotatable with respect to the main body case 2 is exposed from a cylinder end portion 2*d* on an opposite side to the cylinder end portion 2*a* of the main body case 2. A sample of a print image of a print face of this date stamp 1 is formed on a sample face 206 on the bottom face on the opposite side to the print face of the date stamp 1. In this sample, a portion corresponding to the print image of the movable print face 211 is changeable interlocking when the movable print face 211 is changed over.

As shown in FIG. 3, when the rear end portion 205 is rotated at substantially 180° along the circumference of the main body case 2 with the main body case 2 held, the supporting case 201 is rotated together with the rear end portion 205. Then, a slide type operation portion 221 is exposed from an opening portion 2*b* which is made on the outer peripheral face of the main body case 2. As described later, the combination of the movable print face 211 can be changed by operating this operation portion 221.

As shown in FIG. 4, a movable print portion 200 for holding the movable print face 211 and a fixed print portion 100 for holding the fixed print face 111 are accommodated inside the main body case 2. The fixed print portion 100 comprises a fixed print body 112 (see FIG. 6) on which the fixed print face 111 is formed, an ink storage body 113 (see FIG. 6) which makes a contact with the fixed print body 112 to supply ink, and a base portion 120 which holds the fixed print body 112 and the ink storage body 113 and is fit to an internal face of the cylinder end portion 2*a* of the main body case 2. Two spiral grooves 121 are provided in an outer face of the base portion 120 in order to close the opening of the cylinder end portion 2*a* with the fixed print portion 100 with the movable print portion 200 accommodated in the main body case 2. Two bosses 2*c* protruded from the internal face of the cylinder end portion 2*a* of the main body case 2 such that they oppose each other are engaged the spiral groove 121.

A substantially rectangular exposure hole 114 is provided substantially in the center of the fixed print face 111 of the fixed print portion 100 such that it passes through the fixed print portion 100 in a direction perpendicular to the fixed print face 111. The exposure hole 114 is a hole for exposing the movable print face 211 of the movable print body 210 from the main body case 2. Protrusions 122 are provided on both sides in the direction of the short side of the exposure hole 114 of the side face of the base portion 120, which engage an engaging portion (not shown) provided on the inside face of the cap 10.

Two pairs of guide members 123 are provided to project from the inside of the base portion 120 of the fixed print portion 100 in an opposite direction to the fixed print face 111. Two guide pieces 232 projected on the side face in the short side direction of the holding body 230 of the movable print portion 200 described later are nipped between each pair of the guide members 123. Thus, the fixed print portion 100 is limited in its moving direction to the movable print portion 200 so that it is capable of sliding only in the axial direction.

Next, the movable print portion 200 supports the holding body 230 holding the movable print body 210 in its cylindrical supporting case 201. As shown in FIGS. 5 and 6, the movable print body 210 is fixed on the outer peripheral face of five belt bodies 220 supported in parallel such that they are capable of rotating individually along the length direction of the substantially rectangular plate-like holding body 230 and their positions are moved by rotating the belt bodies 220. The movable print body 210 is provided protrudedly on the outer peripheral face of the belt body 220 and a plurality of print portions 212 each having a movable print face 211 at its end are provided in line along the rotation direction of the belt body 220. Roots of the respective print portions 212 are connected with a connecting portion 213. The length of the movable print body 210 is less than half the belt body 220. The print portion 212 having the movable print face 211 and the connecting portion 213, constituting the movable print body 210 are formed integrally of, for example, ink contained body such as porous resin.

The operation portion 221 is provided protrudedly on the outer peripheral face of the belt body 220, the operation portion 221 being operated when rotating the respective belt bodies 220 individually. By sliding the operation portion 221 along the length direction of the holding body 230, the belt body 220 can be rotated. Further, a sample 222 of a print image corresponding to the movable print face 211 of each print portion 212 is printed on the outer peripheral face on an opposite side to the outer peripheral face of the belt body 220 on which the movable print body 210 is fixed. When the operation portion 221 is operated so that any print portion 212 is located on the side face 233 on one side in the length direction of the holding body 230 (side face 233 on the bottom of the drawing in FIG. 6), the sample 222 of the print image corresponding to that movable print face 211 is located on the other side face 234 (side face 234 on the top side of the drawing in FIG. 6). For example, as regards a belt body 220*a* in the middle in the Figure, a selected print portion 212*a* is located on the side face 233 and a print sample "1" of a print image "1" (a portion in which "1" is printed of a sample 222*a*) formed by the print face 211*a* is located on the side face 234. Likewise, as regards a belt body 220*b* on the left end in the Figure, a selected print portion 212*b* is located on the side face 233 and a print sample "0" of a print image "0" of its print face 211*b* (a portion in which "0" is printed of a sample 222*b*) is located on the side face 234.

As shown in FIG. 6, a circular concavity (see FIG. 7) is formed in a sample face 206 at the rear end portion 205 of the supporting case 201 and a sample window 206*a* is opened in its bottom face 206*b*. A portion of the sample 222 located on the side face 234 of the holding body 230 can be seen through this sample window 206*a*. The sample window 206*a* is covered with a transparent cover 208 which engages the concavity in the sample face 206 in order to protect the inside of the date stamp 1 from invasion of dust. As shown in FIG. 7, an image sample 207 of the fixed print face 111 (see FIG. 1) is nipped between the transparent cover 208 and the bottom face 206*b* of the sample face 206. This sample 207 of the print image is formed circularly like the fixed print face 111 and an opening 207*a* is provided substantially in the center to prevent the sample window 206*a* from being closed.

Next, as shown in FIG. 6, a convex portion 223 which is urged to be able to advance or retreat in a direction perpendicular to the sliding direction of the operation portion 221 is provided protrudedly on the back side of the operation portion 221 of the belt body 220. Concave portions 231 which position by engaging the convex portion 223 to give a load to a rotation of the belt body 220 are provided in the same quantity as the print portions 212 along the rotation direction of the belt body 220 inside the holding body 230. This configuration is for positioning the belt body 220 such that when the convex portion 223 engages the concave portion 231, the print portion 212 corresponding to that concave portion 231 is located on the side face 233 of the holding body 230. The respective print portions 212 of the five belt bodies 220 positioned in this way are arranged in parallel. When the movable print portion 200 is accommodated in the main body case 2 and lidded with the fixed print portion 100, those print portions 212 are inserted into the exposure hole 114 such that their parallel arrangement direction meets the length direction of the exposure hole 114. At this time, when each of the two guide pieces 232 provided protrudedly on the side faces in the direction of the short side of the holding bodies 230 of the movable print portion 200 shown in FIG. 5 is nipped between each of two pairs of the guide members 123, shown in FIG. 4, provided such that it protrudes in a direction opposite to the fixed print face 111 from inside of the base portion 120 of the fixed print portion 100, the parallel direction of the print portions 212 meet the length direction of the exposure hole 114. The operation portion 221 corresponds to "moving means" of the present invention and the convex portion 223 and concave portion 231 correspond to "load applying means" of the present invention.

As described previously, the supporting case 201 shown in FIG. 4 is formed cylindrically along the internal face of the main body case 2 because it is accommodated in the main body case 2 and four narrow groove-like guide grooves 202 are opened along the axial direction in one side face. When the holding body 230 is accommodated in the supporting case 201, the respective operation portions 221 of the five belt bodies 220 (see FIG. 5) are protruded out of the supporting case 201 such that the operation portions 221 of two belt bodies 220 on the side of an end are protruded from the same groove 202 while the operation portions 221 of the remaining three belt bodies 220 are protruded from independent guide grooves 202.

When assembling the date stamp 1 having such a configuration, first, with the rear end portion 205 separated, the supporting case 201 is inserted into the main body case 2 through the cylinder end portion 2*a* of the main body case 2 and the rear end portion 205 is fixed by engaging with the supporting case 201 through the cylinder end portion 2*d* (the engagement portion is not shown here) Then, each of the two guide pieces 232 of the holding body 230 is let to be nipped between the pair of the guide members 123 of the fixed print portion 100 at the cylinder end portion 2*a* and the bosses 2*c* of the main body case 2 are engaged with the spiral groove 121 in the fixed print portion 100 so that the fixed print portion 100 is installed. To prevent the fixed print portion 100 from loosing out easily, a stopper (not shown) is swollen from the bottom face in the vicinity of a starting end of the spiral groove 121. At a position where the boss 2*c* is restricted by the stopper, as shown in FIG. 3, all the four guide grooves 202 are exposed from the opening portion 2*b* and as shown in FIG. 6, a selected movable print face 211 of the movable print body 210 is pulled out of the exposure hole 114 of the fixed print portion 100. If the operation portion 221 is operated with this condition, an arbitrary movable print face 211 can be selected.

Next, bosses 2*c* are slid along the spiral groove 121 by rotating the fixed print portion 100. At this time, because the guide pieces 232 are nipped by the guide members 123, when the fixed print portion 100 is rotated, the supporting case 201 is also rotated. Thus, this operation can be carried out by rotating the rear end portion 205 of the supporting case 201 with respect to the main body case 2. If the boss 2*c* is guided by the spiral groove 121, as shown in FIG. 1, the fixed print portion 100 is moved in a direction that it is accommodated in the main body case 2 and when the boss 2*c* reaches a final end of the spiral groove 121, as shown in FIG. 8, the fixed print portion 100 is positioned to the main body case 2.

As shown in FIG. 8, in the fixed print portion 100, the fixed print body 112 and the ink storage body 113 are held by the cylindrical base portion 120 and the fixed print face 111 of the fixed print body 112 is exposed on the front surface. The ink storage body 113 is made of, for example, porous resin, which can be soaked with ink to store the ink. The fixed print body 112 is also made of porous resin, in which optical energy absorbent material is dispersed.

The fixed print face 111 is formed by a well known plate making machine (not shown). A picture to be formed on the print face is created with a plate making machine or a personal computer connected to the plate making machine and that picture is printed on a transparent film or the like. With the fixed print body 112 held in a compressed state, if light is irradiated on the fixed print face 111 by making, for example, a xenon tube emit light through a film or the like on which the picture is printed, light is intercepted at a printed portion on the film or the like so that selective irradiation of light is carried out. Then, a light irradiated portion of the fixed print face 111 is melted due to heat generation of the optical energy absorbent material and after that, it is hardened. As a consequence, holes at that portion are clogged so that no ink oozes to the fixed print face 111 from the fixed print body 112. On the other hand, at a portion not irradiated with light, holes are not clogged so that ink can ooze to the fixed print face 111. The fixed print face 111 created in this manner can form the same print image as a picture printed on the film or the like. Further, at the plate making machine, when a picture is printed on the film or the like, the sample 207 shown in FIG. 7 is printed at the same time. The sample 207 may be printed on, for example, a regular paper or an arbitrary paper and if it is printed on the regular paper, the opening 207*a* may be made in that paper preliminarily.

As shown in FIG. 8, on a face opposite to the face of the ink storage body 113 which makes contact with the fixed print body 112, an ink transmitting body 130 which makes contact with the print portion 212 of the movable print body 210 is provided such that it is in contact with the ink storage body 113. The ink transmitting body 130 is made of, for example, felt or other member and transmits ink impregnated in the ink storage body 113 of the fixed print portion 100 to the print portion 212 of the movable print body 210 making in contact with the ink transmitting body 130 using capillary action so as to supply ink. The ink transmitted by the ink transmitting portion 130 from the ink storage body 113 is dispersed entirely in the movable print body 210 made of ink impregnating material so that the ink is delivered to respective print portions 212.

By the way, the rear end portion 205 of the supporting case 201 is constructed in a diameter larger than the internal periphery of the cylinder end portion 2*d* of the main body case 2 to prevent the supporting case 201 from moving to the side of the cylinder end portion 2*a*. Collar 203 shown in FIGS. 4, 6 and 8 blocks the supporting case 201 from moving to the side of the cylinder end portion 2*d* based on a difference in diameter between the cylinder end portion 2*a* and the cylinder body. Thus, even when the fixed print portion 100 is loaded or unloaded, the position of the supporting case 201 to the main body case 2 in the axial direction of the main body case 2 is not changed. That is, as regards the holding portion 230 supported by the supporting case 201 also, its positional relation with the supporting case 201 in the axial direction of the main body case 2 and the positional relation with the main body case 2 are not changed regardless of whether the fixed print portion 100 is loaded or unloaded.

As a consequence, even if the fixed print portion 100 shown in FIG. 8 is rotated to select the movable print face 211 and as shown in FIG. 6, the print portion 212 is pulled out of the exposure hole 114, the distance between the sample window 206*a* and the side face 234 of the holding body 230 is not increased. Thus, during selection of the movable print face 211 (date), the sample 222 is always kept at a distance enabling itself to be seen well. With this condition, a user selects the movable print face 211 by sliding the operation portion 221 and he can imagine a print result by just seeing the sample face 206 without trial stamping. Although to select the movable print face 211, conventionally, a desired print face is selected from the movable print face 211 indicated with mirror image by peeping into the print face, the movable print face 211 can be selected easily without peeping into the print face. Further, because as shown in FIG. 2, the size of the sample 207 is the same as that of print made by the plate making machine, that is, the size of the fixed print face 111, the size of the opening 207*a* in the sample 207 is the same as the size of the opening of the exposure hole 114. Thus, when selecting the movable print face 211, no excessive thing is seen so that a stamp result can be imagined easily.

As described above, in the date stamp 1 of this embodiment, a sample of a stamp image of a print face of this date stamp 1 is formed on the sample face 206 which is a bottom face opposite to the print face of the date stamp 1. In the sample of the print image, a portion corresponding to the sample of the print image of the movable print face 211 is changed interlockingly when the movable print face 211 is changed. Because a user can select the movable print face 211 while looking at this sample face 206, he can select the movable print face 211 (date) imaging a print result. Further, because the sample 207 which is a sample of the print image of the fixed print face 111 is printed at the same time when the fixed print face 111 is formed with the plate making machine, the image of the fixed print face 111 and the image of the sample 207 can be created at the same time.

Figure 9:
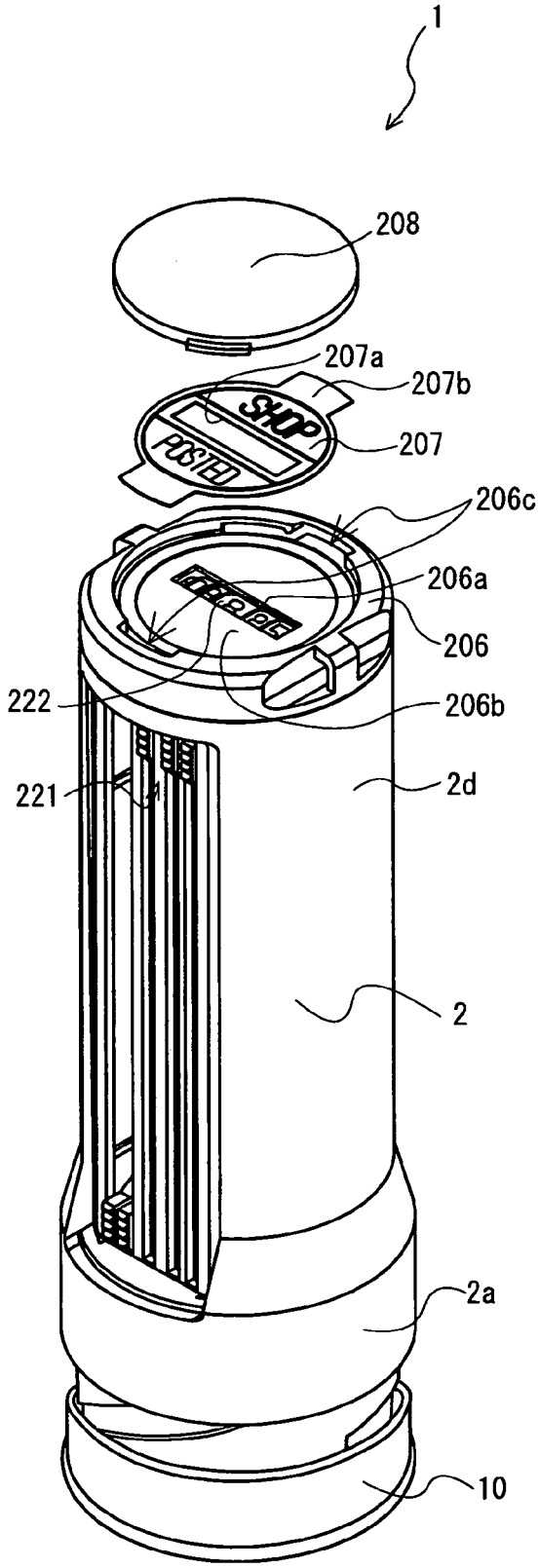
FIG. 9 is a perspective view of a modification of a date stamp 1 as seen from the rear end portion 205.

It is needless to say that the present invention can be modified in various ways. For example, although according to this embodiment, the sample 207 is formed circularly, it is permissible to provide positioning pieces 207*b* at end portions as shown in FIG. 9. In this case, by providing engaging portions 206*c* which the positioning pieces 207*b* engage in a sample face 206 formed concavely, positioning of the sample 207 is facilitated thereby reducing time and labor for creating the date stamp 1. The engaging portions 206*c* may be provided newly, or may use a portion which engages the transparent cover 208 with the sample face 206 as shown in FIG. 9.

Figure 10:
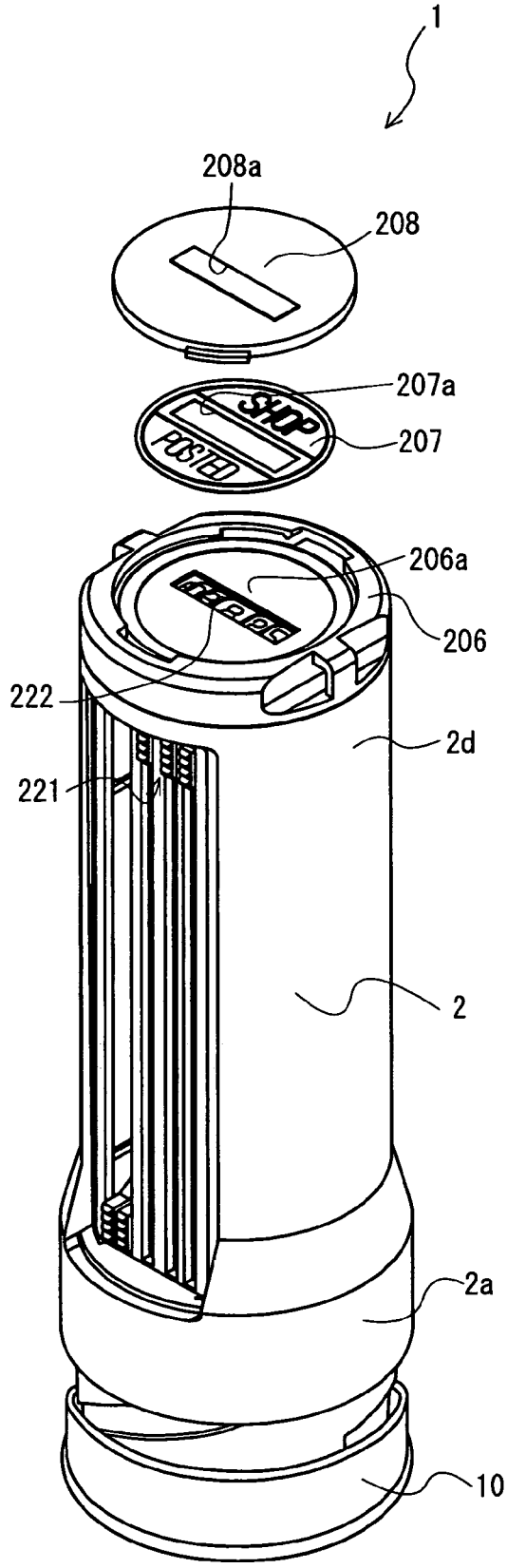
FIG. 10 is a perspective view of a modification of a date stamp 1 as seen from the rear end portion 205.

Further, as shown in FIG. 10, it is permissible to provide a protrusion 208*a* may be provided in the transparent cover 208 to engage the internal periphery of the opening 207*a* in the sample 207. As a result, the sample 207 can be prevented from deflecting in position by the protrusion 208*a*. Further, the protrusions 208*a* may be provided protrudedly on four corners for positioning the sample 207 or, may be provided only on two diagonal corners. Further, the sample 207 may be bonded on the transparent cover 208 positioned under the above-mentioned structure by coating the print face thereof with adhesive agent. The opening 207*a* in the sample 207 corresponds to "monitoring hole" of the present invention and the protrusion 208*a* corresponds to "fitting piece" of the present invention.

Figure 11:
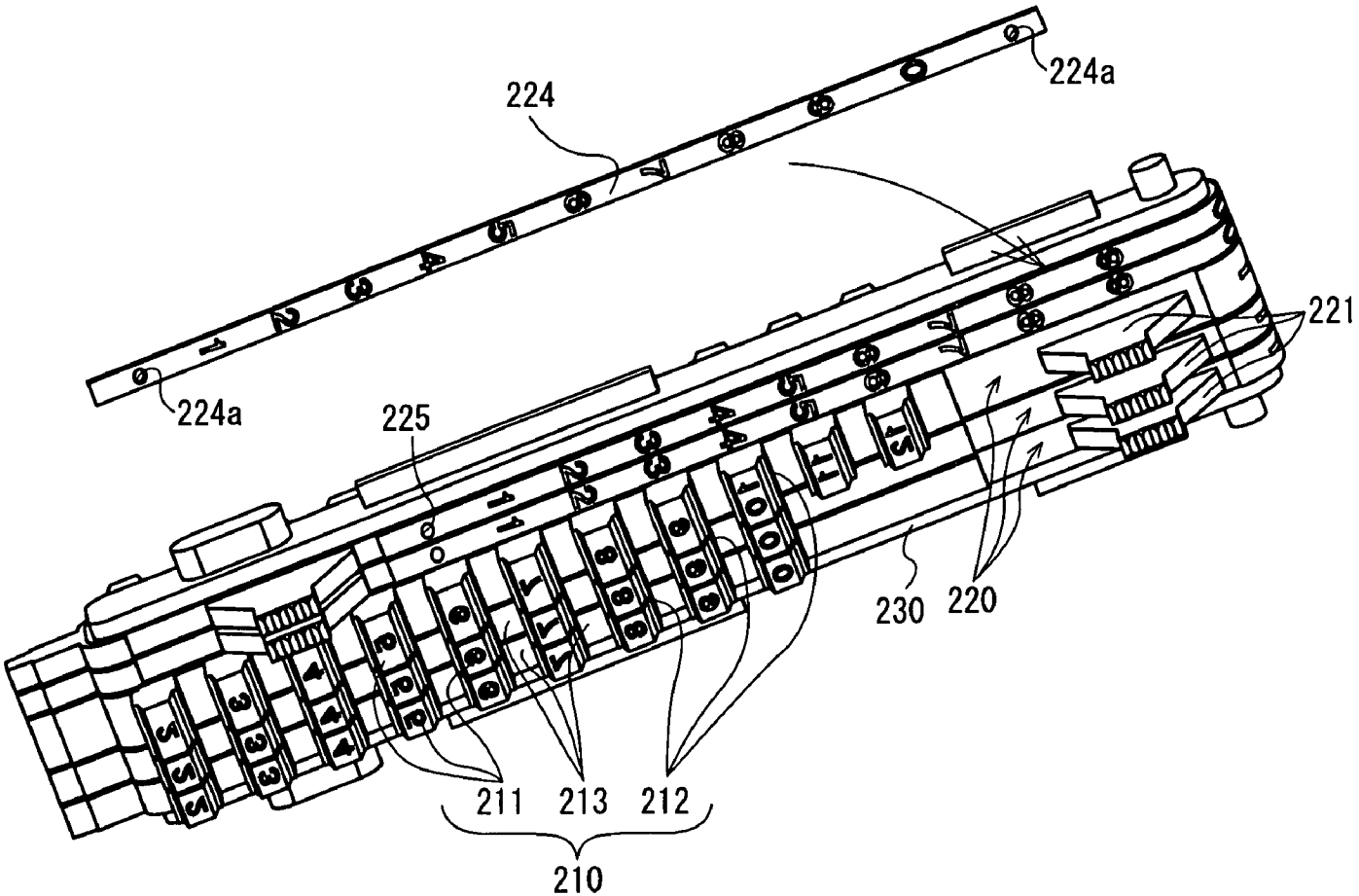
FIG. 11 is a perspective view of the holding body 230 which holds a movable stamp body 210, indicating a modification of the date stamp 1.

Although according to this embodiment, the sample 222 is printed on the belt body 220, a belt-like film member 224 may be bonded on the belt body 220 as shown in FIG. 11 having a substantially same width on which a print sample is printed as the belt body 220. At this time, by providing positioning holes 224*a* on both ends of the film member 224 and positioning protrusions 225 to engage the positioning holes 224*a* on the surface of the belt body 220, positioning of the film member 224 on the belt body 220 is facilitated. The film member 224 and the belt body 220 may be bonded together with adhesive agent or by melting the positioning protrusion 225 engaging the positioning hole 224*a* with heat, so that the positioning holes 224*a* do not leave the positioning protrusions 225.

Further, when producing the sample 207 with the plate making machine, a base sheet of the sample 207 may be formed of sealing member. As a result, the sample 207 sandwiched between the bottom face 206*b* of the sample face 206 and the transparent cover 208 can be prevented from deflecting in position during use of the date stamp 1.

Although according to this embodiment, the sample face 206 is provided on the bottom face opposite to the print face of the main body case 2, it may be provided on the side face of the main body case 2. In this case, it is recommendable to provide the sample face in the vicinity of the cylinder end portion 2*d* far from the print face. If considering penetration of ink into the print face, it is desirable to keep the date stamp 1 such that its print face is down when the date stamp 1 is not used. At this time, the sample face 206 is positioned at an upper position of the date stamp 1, a user can see its print sample easily.

Although in the present embodiment, the present invention has been described about a date stamp, it can be applied to a number stamp, an address stamp and the like preferably.

INDUSTRIAL APPLICABILITY

The present invention can be applied to a rotation type and a sliding type date stamp, number stamp, address stamp and the like.

The invention claimed is:

1. A stamp comprising:

a movable print body including a plurality of print faces provided protrudedly along an outer face of a belt supported movably;

a supporting case at least partially enclosing the movable print body;

a main body case at least partially enclosing the supporting case, the supporting case being configured to rotate along a circumference of the main body case;

an exposure hole for exposing one of the plurality of print faces of the movable print body out of the main body case;

a fixed print body that constitutes a face of the main body case provided with the exposure hole and has a fixed print face for forming a print image synthesized together with a print face of the movable print body exposed through the exposure hole;

a plurality of print image samples corresponding to the plurality of print faces of the movable print body and the fixed print face of the fixed print body;

a sample window provided in a face of the supporting case opposite the exposure hole to enable the print image samples corresponding to the print face of the movable print body exposed through the exposure hole to be seen from outside the main body case, wherein the print image sample of the fixed print face of the fixed print body is synthesized with a print image sample of the print face of the movable print body visible through the sample window, such that the print image samples of the print faces of the fixed print body and the moveable print body are visibly recognizable, and wherein the main body case is constructed cylindrically while the exposure hole and the sample window are provided on the side face at an end and the side face at another end of the main body case; and a transparent cover for covering the side face at the other end of the main body case to protect the sample window, wherein the print image sample of the fixed print face of the fixed print body is held between the main body case and the cover, wherein the print image sample of the fixed print face of the fixed print body has a monitoring hole enabling the print image sample of the print face of the movable print body to be seen, and wherein the cover has a fitting piece capable of being fit to the monitoring hole.

2. The stamp according to claim 1, wherein the print image sample of the print face of the movable print body is printed on an outside face of the belt of the movable print body, provided with no protruded print faces.

3. The stamp according to claim 1, wherein the print image sample of the print face of the movable print body is printed on a belt-like film member to be bonded to the outside face of the belt of the movable print body, provided with no protruded print faces.

4. The stamp according to claim 1, wherein:

the print image sample of the print face of the movable print body is printed on the belt-like film member, a positioning hole for positioning to the movable print body is made in the film member, and a positioning protrusion that is fit to the positioning hole in the film member is provided protrudedly on the outside face of the movable print body provided with no protruded print faces.

5. The stamp according to claim 1, further comprising:

a moving means capable of moving the movable print body to select an arbitrary print face from the plurality of print faces of the movable print body; and a load applying means for, when the respective print faces are pulled out of the exposure hole in order to move the movable print body with the moving means, applying load to the moving means to make it difficult for the movable print body to move.

6. The stamp according to claim 1, wherein the print image sample of the print face of the movable print body is printed on an outside face of the belt of the movable print body, provided with no protruded print faces.

7. The stamp according to claim 1, wherein the print image sample of the print face of the movable print body is printed on a belt-like film member to be bonded to the outside face of the belt of the movable print body, provided with no protruded print faces.

8. The stamp according to claim 1, wherein:

the print image sample of the print face of the movable print body is printed on the belt-like film member, positioning hole for positioning to the movable print body is made in the film member, and a positioning protrusion that is fit to the positioning hole in the film member is provided protrudedly on the outside face of the movable print body provided with no protruded print faces.

9. The stamp according to claim 1, wherein:

the fixed print body is provided so as to be attachable to or detachable from the main body case, and the movable print body is supported by the main body case such that its positional relation with the sample window is not changed.

10. The stamp according to claim 1, further comprising:

a moving means capable of moving the movable print body to select an arbitrary print face from the plurality of print faces of the movable print body; and a load applying means for, when the respective print faces are pulled out of the exposure hole in order to move the movable print body with the moving means, applying load to the moving means to make it difficult for the movable print body to move.

11. The stamp according to claim 1, wherein the print image sample of the fixed print face of the fixed print body has a positioning piece for positioning at ends thereof and the side face of the other end of the main body case has an engaging portion which the positioning piece engages.

12. The stamp according to claim 1, wherein the main body case is constructed cylindrically while the exposure hole and the sample window are provided on the side face at an end and the side face at the other end of the main body case.

13. The stamp according to claim 12, further comprising:

a transparent cover for covering the side face at the other end of the main body case to protect the sample window, wherein the print image sample of the fixed print face of the fixed print body is held between the main body case and the cover.

14. The stamp according to claim 13, wherein the print image sample of the fixed print face of the fixed print body has a positioning piece for positioning at ends thereof and the side face of the other end of the main body case has an engaging portion which the positioning piece engages.

15. The stamp according to claim 13, wherein:

the print image sample of the fixed print face of the fixed print body has a monitoring hole enabling the print image sample of the print face of the movable print body to be seen, and the cover has a fitting piece capable of being fit to the monitoring hole.

* * * * *

UNITED STATES PATENT AND TRADEMARK OFFICE

CERTIFICATE OF CORRECTION

PATENT NO. : 7,765,924 B2
APPLICATION NO. : 10/556072
DATED : August 3, 2010
INVENTOR(S) : Suda It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1043 days.

Please delete the following:

Item "(86) PCT No.: PCT/JP2004/013725

§371 (c)(1),
(2), (4) Date: Nov. 30, 2006"

And replace with:

Item (86) PCT No.: PCT/JP2004/013725

§371 (c)(1),
(2), (4) Date: Dec. 12, 2005

Signed and Sealed this
Fifth Day of April, 2011

David J. Kappos

David J. Kappos
*Director of the United States Patent and Trademark Office*